US008082959B2

(12) United States Patent
Boucké

(10) Patent No.: US 8,082,959 B2
(45) Date of Patent: Dec. 27, 2011

(54) METHOD OF MANUFACTURING A PANEL

(75) Inventor: Eddy Boucké, Menen (BE)

(73) Assignee: Berry Finance N.V. (BE)

( * ) Notice: Subject to any disclaimer, the term of this patent is extended or adjusted under 35 U.S.C. 154(b) by 627 days.

(21) Appl. No.: 11/817,332

(22) PCT Filed: May 4, 2006

(86) PCT No.: PCT/EP2006/004195
§ 371 (c)(1),
(2), (4) Date: Sep. 3, 2008

(87) PCT Pub. No.: WO2006/117229
PCT Pub. Date: Nov. 9, 2006

(65) Prior Publication Data

US 2009/0101236 A1 Apr. 23, 2009

(30) Foreign Application Priority Data

May 4, 2005 (EP) ..... 05009850

(51) Int. Cl.
*B27D 1/00* (2006.01)

(52) U.S. Cl. ..... 144/350

(58) Field of Classification Search ..... 144/359, 144/360, 361, 363, 364, 380; 408/701; 29/897, 29/557, 558, 897.32; 52/589.1, 515; 219/121.67, 219/121.18
See application file for complete search history.

(56) References Cited

U.S. PATENT DOCUMENTS

| | | | | |
|---|---|---|---|---|
| 4,335,296 | A * | 6/1982 | Bredow | 219/121.67 |
| 4,469,931 | A * | 9/1984 | Macken | 219/121.67 |
| 4,943,700 | A * | 7/1990 | Hughes et al. | 219/121.67 |
| 5,357,728 | A | 10/1994 | Duncanson | |
| 5,578,229 | A * | 11/1996 | Barnekov et al. | 219/121.72 |
| 5,862,845 | A | 1/1999 | Chin et al. | |
| 6,006,486 | A | 12/1999 | Moriau et al. | |
| 6,393,687 | B1 * | 5/2002 | Friedrich | 29/560 |
| 6,647,690 | B1 | 11/2003 | Martensson | |
| 2002/0179582 | A1 * | 12/2002 | Reichmann et al. | 219/121.84 |
| 2008/0172856 | A1 * | 7/2008 | Brouckaert et al. | 29/557 |

FOREIGN PATENT DOCUMENTS

| | | | |
|---|---|---|---|
| EP | 1437456 | A1 | 7/2004 |
| WO | WO 2006031169 | A1 * | 3/2006 |
| WO | WO 2007012561 | A1 * | 2/2007 |

OTHER PUBLICATIONS

Barnekov et al, Laser Machining Wood Composites, Oct. 1989, Forest Products Journal, vol. 39, No. 10.*

* cited by examiner

*Primary Examiner* — Jennifer C Chiang
(74) *Attorney, Agent, or Firm* — David I. Roche; Baker & McKenzie LLP

(57) ABSTRACT

A method of manufacturing a panel (2) is described, wherein the panel (2) comprises a core of a fiber material, preferably an MDF or HDF board. In order to improve the quality and precision as well as the water resistance of coverings made from the panel, it is suggested that at least one cut (6, 6*a*, 9) on the panel (1) is cut with a laser.

11 Claims, 11 Drawing Sheets

METHOD OF MANUFACTURING A PANEL

The invention relates to a method of manufacturing a panel of the type described in the pre-characterising portion of claim 1.

Panels are building components in board or strip shape, which can be put together to form a more or less closed surface, e.g. for a floor-covering, a wall or other covering, furniture, etc. Panels may be present in the form of a so-called laminate and they then contain a number of layers of different materials. With a floor panel, for example, the topmost surface in the finished floor covering forms a tread layer, which must be both hard and wear resistant and also fulfil decorative purposes. As a further layer a so-called core is provided which is usually made from fibre materials, preferably from wood-fibre materials, such as MDF boards or HDF boards.

Figure 6:
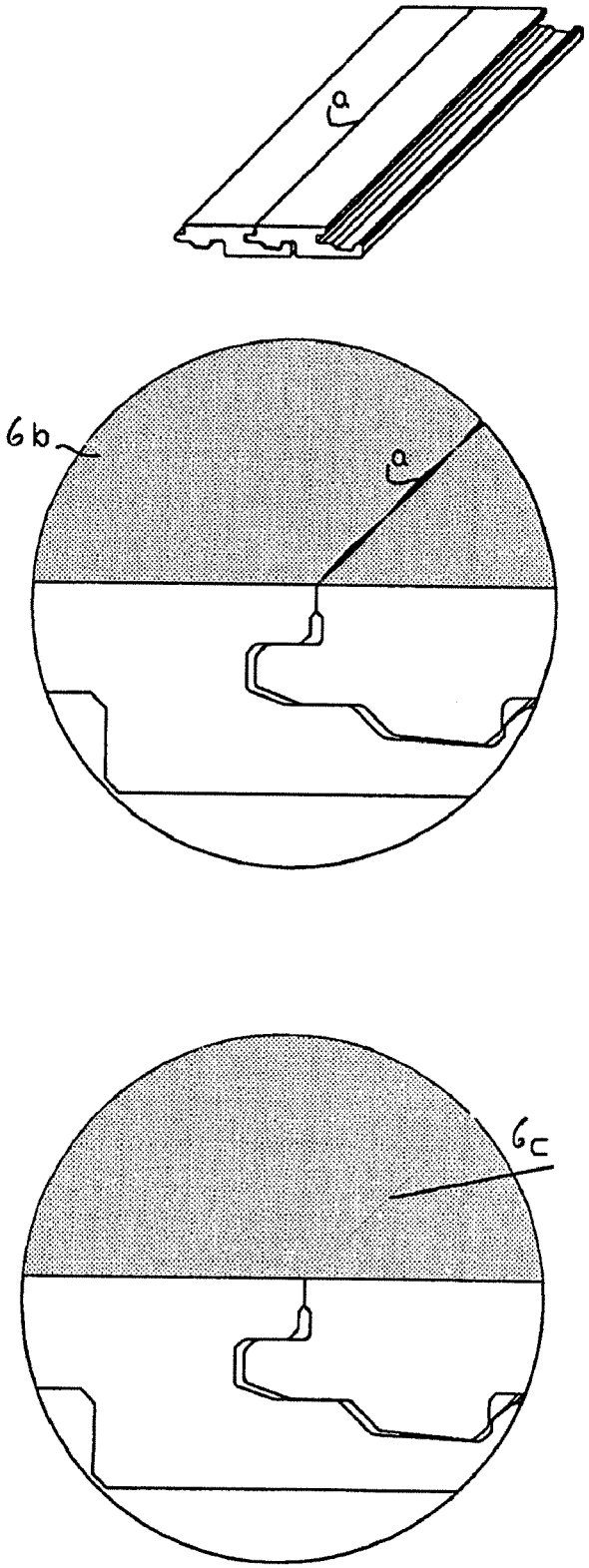
Figure 7:
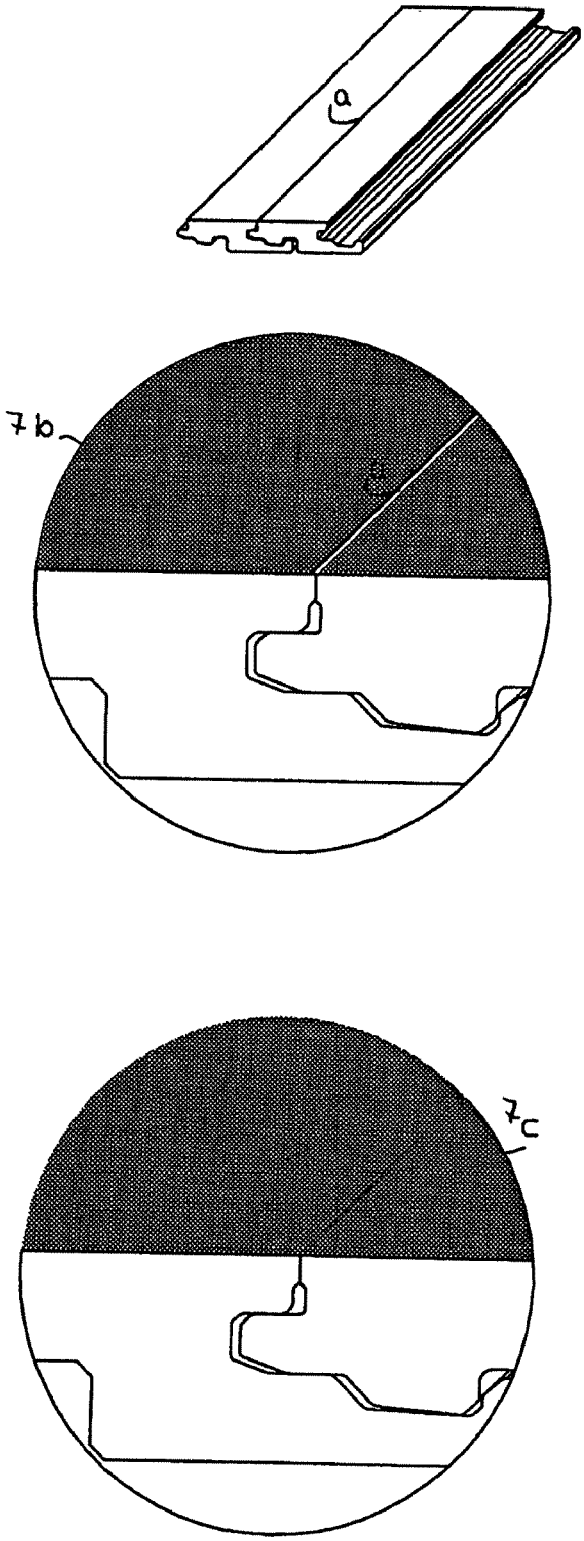
Figure 8:
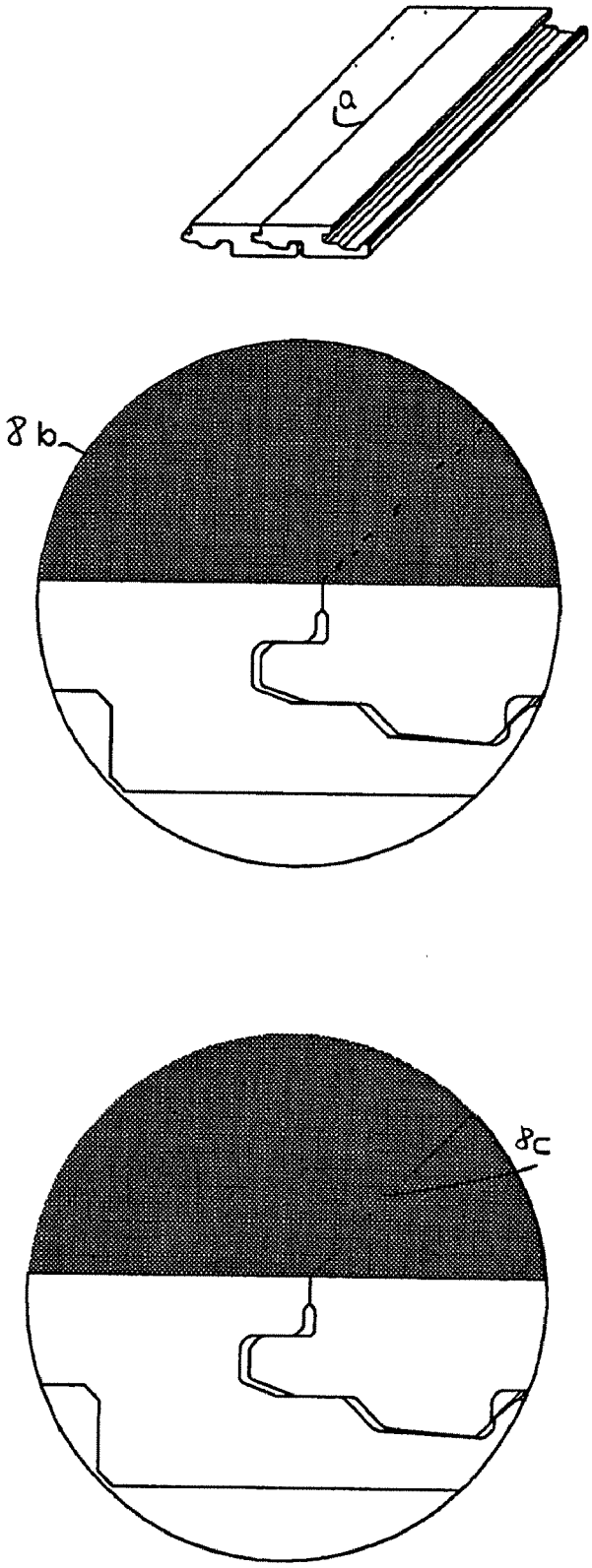
Figure 9:
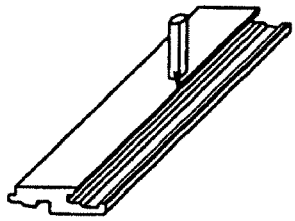
Figure 9A:
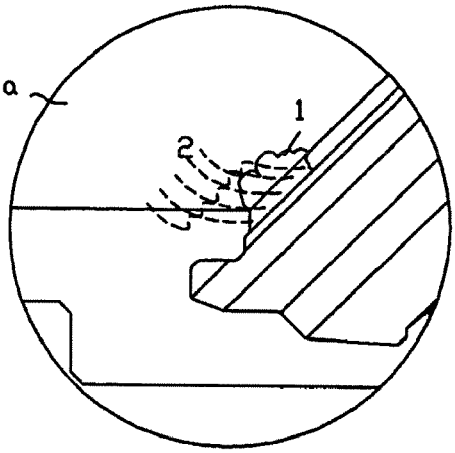
Figure 9B:
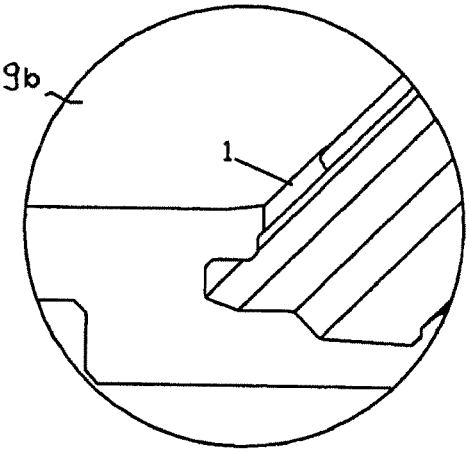
Figure 9C:
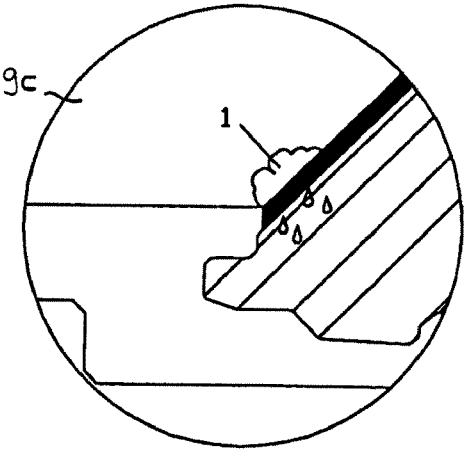

In order to anchor together adjacent panels in the finished surface of a covering often at least two oppositely positioned sides of the panel are provided with a joining profile which comprises corresponding profile elements, which can be joined together by bending them down and/or clipping, such as is described, for example, in WO94/26999 or WO97/47834. Until now panels have been manufactured with mechanical cutting tools, such as for example saws or milling cutters. Here, a board is first provided corresponding to a multiple of the size of a panel, containing the core and a further layer arranged on top of it. Then the board is separated into individual panel blanks. This takes place using tools similar to circular saws with a steel body and cutters fitted with diamonds. Then the joining profile is formed, which in turn occurs through a combination of various sawing and milling tools. Apart from the unavoidable burden of dust and the relatively large kerf width caused by the thickness of the saw, the use of mechanical tools has further disadvantages. These disadvantages are briefly explained based on FIGS. 6 to 12 with an example of a floor panel. A mechanical tool, such as for example a saw blade or a milling cutter, always exerts a certain resistance when a workpiece is pushed against it, which is always relevant with increasing feed rate. Currently, feed rates of 200 m/min or more are used. Rotating tools have the disadvantage that there are high manufacturing tolerances both in the tool and in the drive motor. The result is that the cut line between adjacent panels can take on a wave-shaped form, as is shown with the joining line a in the centre illustration of FIG. 6. If a panel comprises a hard surface layer and is cut with a rotating circular saw, then there is a tendency to fray the edge of the surface layer, resulting in a fine white line at the joining line. This white line is caused by the friction between the tool and the surface layer and can be attributed, for example, to the wear resistant coating material in the surface layer. This fine white line is shown in FIG. 7*b*. The speed with which the panels are passed through the machines is very high. Rotating tools have the disadvantage that the friction becomes greater with higher speeds. A result of this is that not only is the covering layer frayed, but also a second layer situated beneath it (a decorative layer), such as is shown, for example, in FIG. 8*b*. However, if the joining edges of both panels do not lie close together, but instead form cavities and spaces in between them, water can penetrate, such as is shown in FIG. 9. Since the core is usually absorbent, the water is drawn into the core, allowing the core to swell so that a surface layer or one of the other layers can lift up. Mechanical tools must furthermore be resharpened, for which the production equipment must be shut down.

Mechanical tools, in particular saws, have a certain thickness (about 2.5 mm) which can lead to a quite noticeable loss of material. Also, mechanical tools produce a high level of dust which must be extracted, demanding further investment costs.

Figure 10:
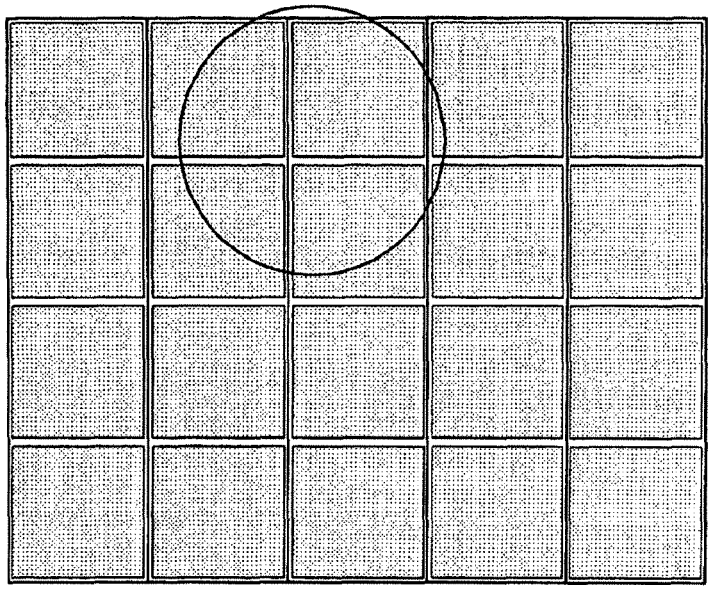
Figure 10:
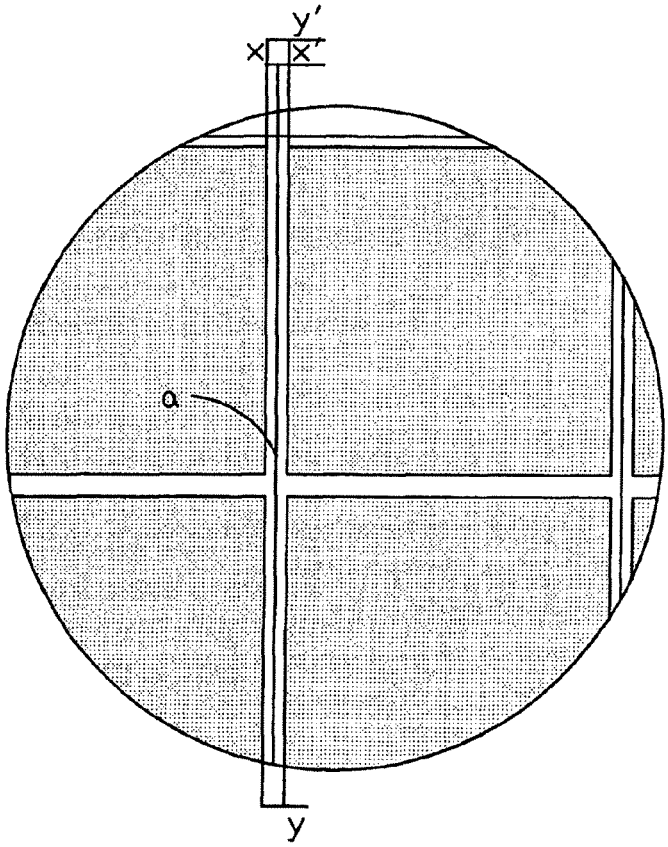
Figure 11:
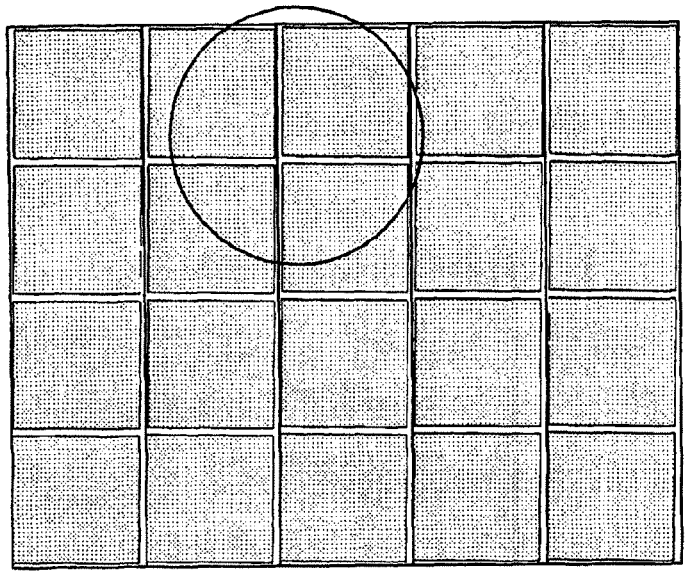
Figure 11:
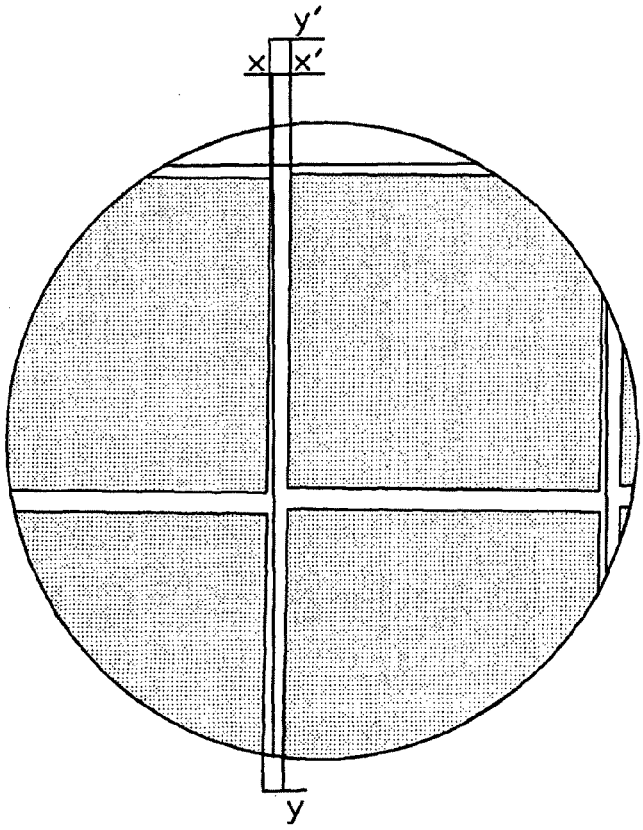
Figure 12:
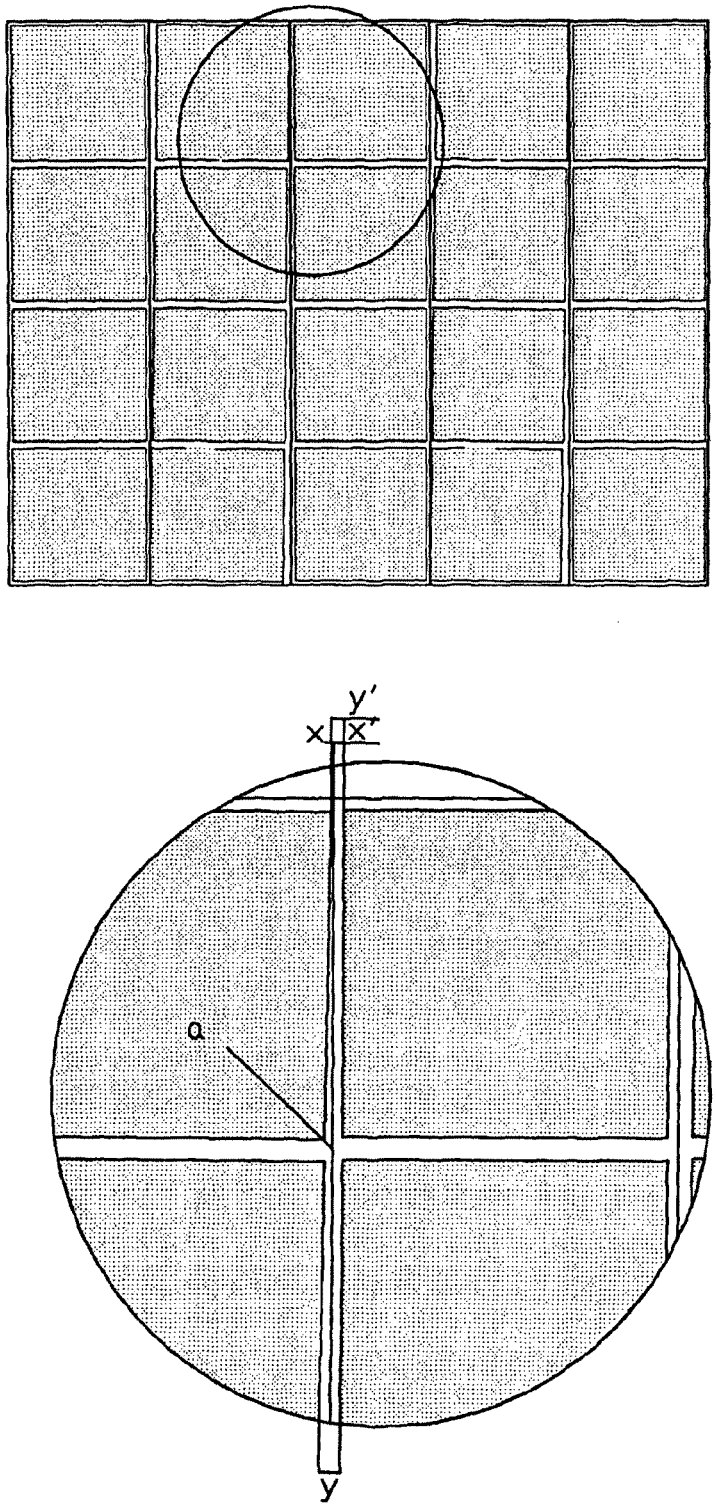

On sawing panel blanks from a board, the complete board is passed through rotating rollers. Then the panel blanks are sawn up and in turn passed out of the sawing machine through guide rollers. It is practically impossible to carry this out without some horizontal displacement of the panels and the board. There are many reasons for this, but it is mainly the combination of the friction of the saw blades and the guide and pressure rollers as well as the mechanical positioning of these components which cause these slight horizontal movements. This should always be prevented if the board or the panels are fitted with a geometrical decoration. FIGS. 10 to 12 show a decoration of this nature, wherein FIG. 10 shows how this is ideally produced and FIGS. 11 and 12 show the problems with the previous manufacture with rotating mechanical tools. In FIG. 10 the distances x and x' on both sides of the joining line are equal (x+x'=y'). FIG. 11 shows a possible result when the panels are not correctly positioned during sawing, as may happen in the state of the art. Here, x and x' are not equal, whereas y is still equal to y', but the joining line is in no way parallel to the edges. When floor panels of this nature are laid, the joining edge is not properly formed and the decorative pattern is incorrectly positioned.

Furthermore, with directly adjoining panels also the smallest splintering and broken-off points on the joining edge are noticeable which with mechanical, rotating tools can never be completely avoided. Also, the friction of the tools on the cut edges and in particular on the tread layer leads to heating, wherein the tread layer, which usually consists of a plastic, may change in colour or in structure. This too produces a poor impression of the finished covering. These irregularities are reinforced further when the machining speed is increased for economic manufacture.

The object of the invention is to provide a method of manufacturing a panel which does not exhibit the above mentioned disadvantages.

The object is solved by the method according to Claim 1 and the panel according to Claim 11.

It has been established that it is possible to completely eliminate the above mentioned disadvantages through the use of a laser at least for particularly stressed or exposed cuts. The laser cut produces neither dust nor any significant mechanical resistance that could dislodge quickly fed workpieces out of alignment. The edge does not break up and friction is not produced. Even the most severe disadvantage which till now discouraged the use of lasers in the processing of fibre materials, i.e. the generation of heat and the ensuing modifications to or combustion on the cut surface turns out to be a decisive advantage in the use for producing panels, because the cut surfaces are as it were sealed. This occurs on one hand due to the melting of binders in the wood-fibre material, for example of melamine resin in HDF or MDF boards and on the other hand due to a type of combustion or coking of the cut surface which compacts its structure, but despite this the edge or cut tracks visible in the joined state remain. FIGS. 6*c*, 7*c*, 8*c* and 10 show in each case perfect, almost invisible joining lines as can be achieved with the invention by using a laser.

Advantageous further developments of the invention can be taken from the dependent claims.

Preferably, particularly exposed edges, such as for example the joining edge in the region of the surface, which in the finished covering is directly visible and shows up any irregularity, are cut by laser using the method according to the invention.

It is however also possible, additionally or alternatively, to cut regions of the core with laser to render them less absorbent to water, particularly at exposed places. If laser technology is employed for cutting a board up into a large number of panel blanks, then here the loss due to wide kerf widths and the production of dust can be decisively reduced and the efficiency increased.

If the natural sealing produced by the laser used for cutting is not sufficient, then the laser can be specially adjusted or selected for this task.

Figure 1:
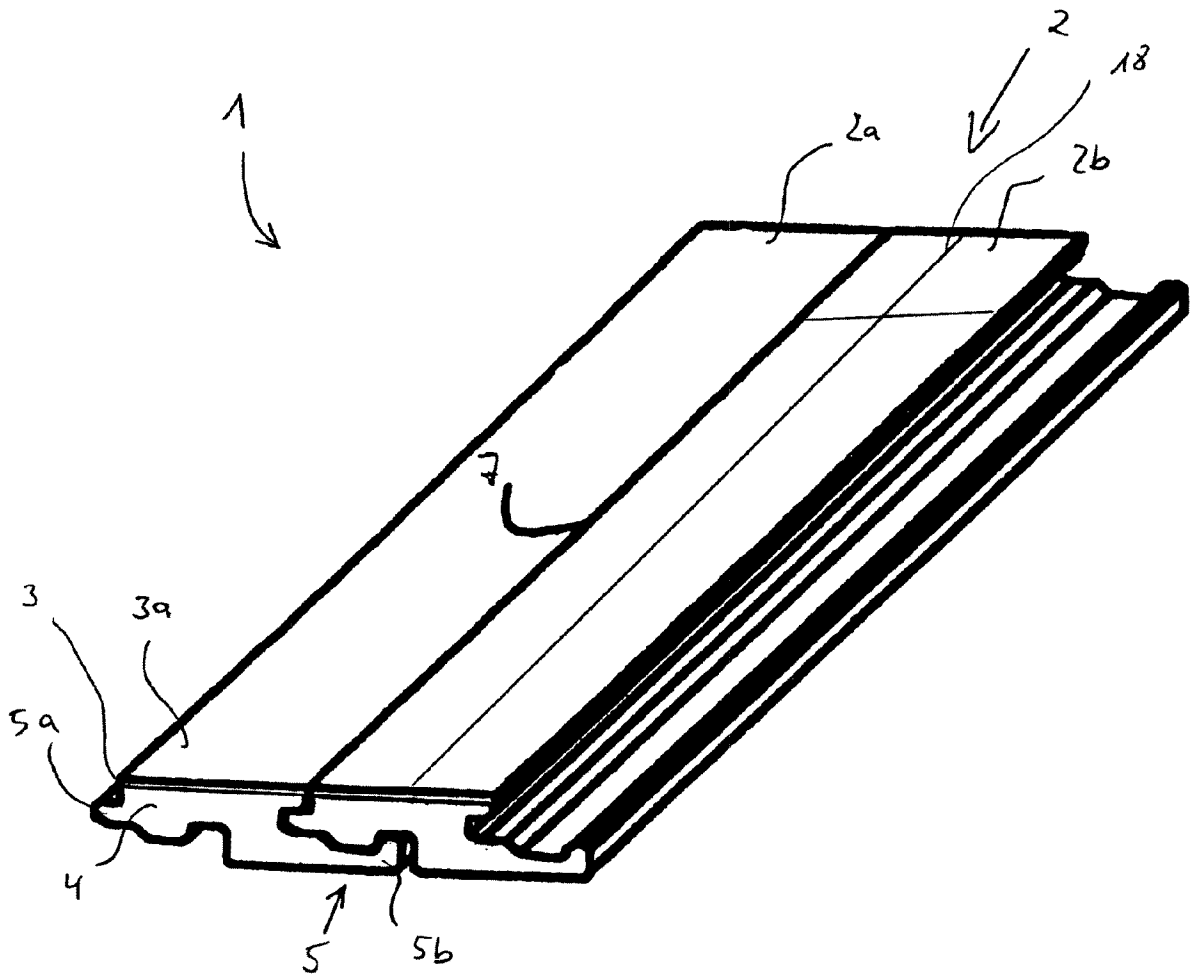
Figure 2:
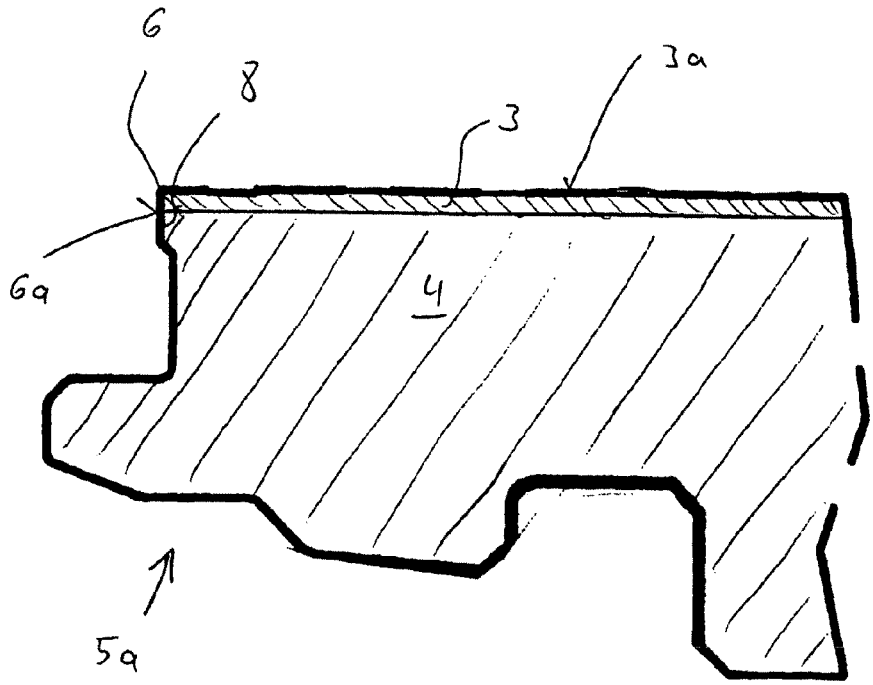
Figure 3:
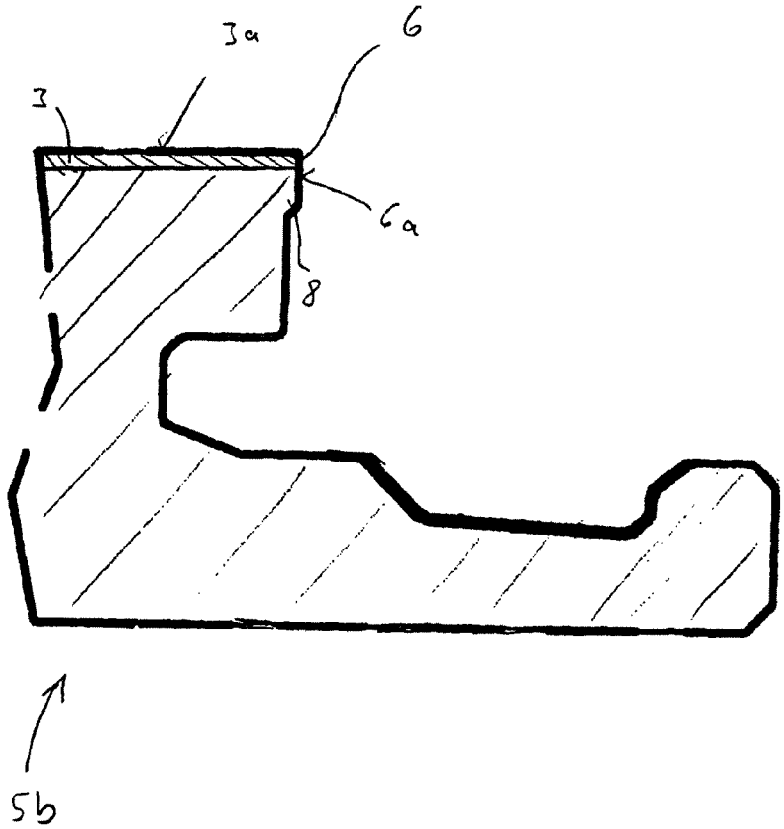
Figure 4:
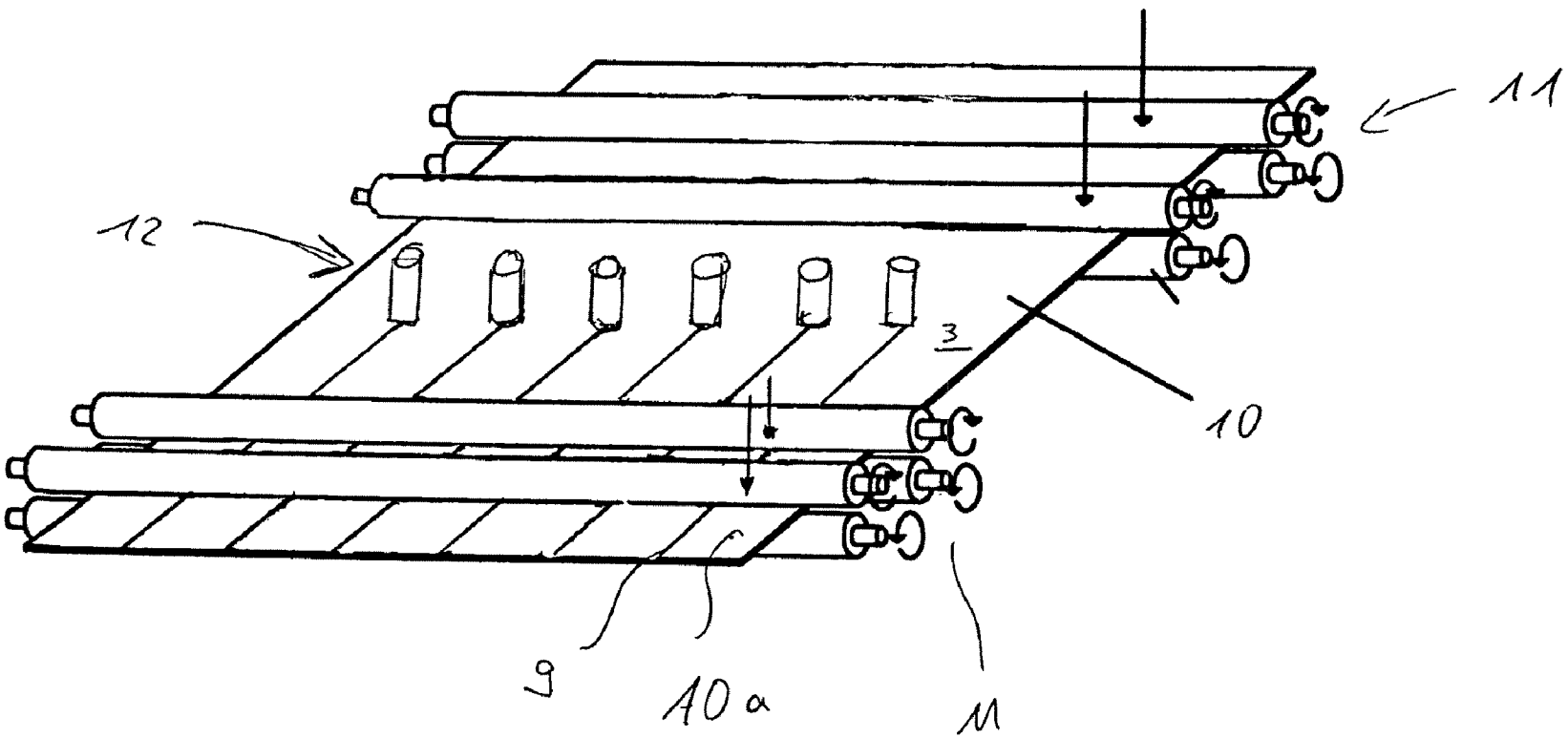
Figure 5:
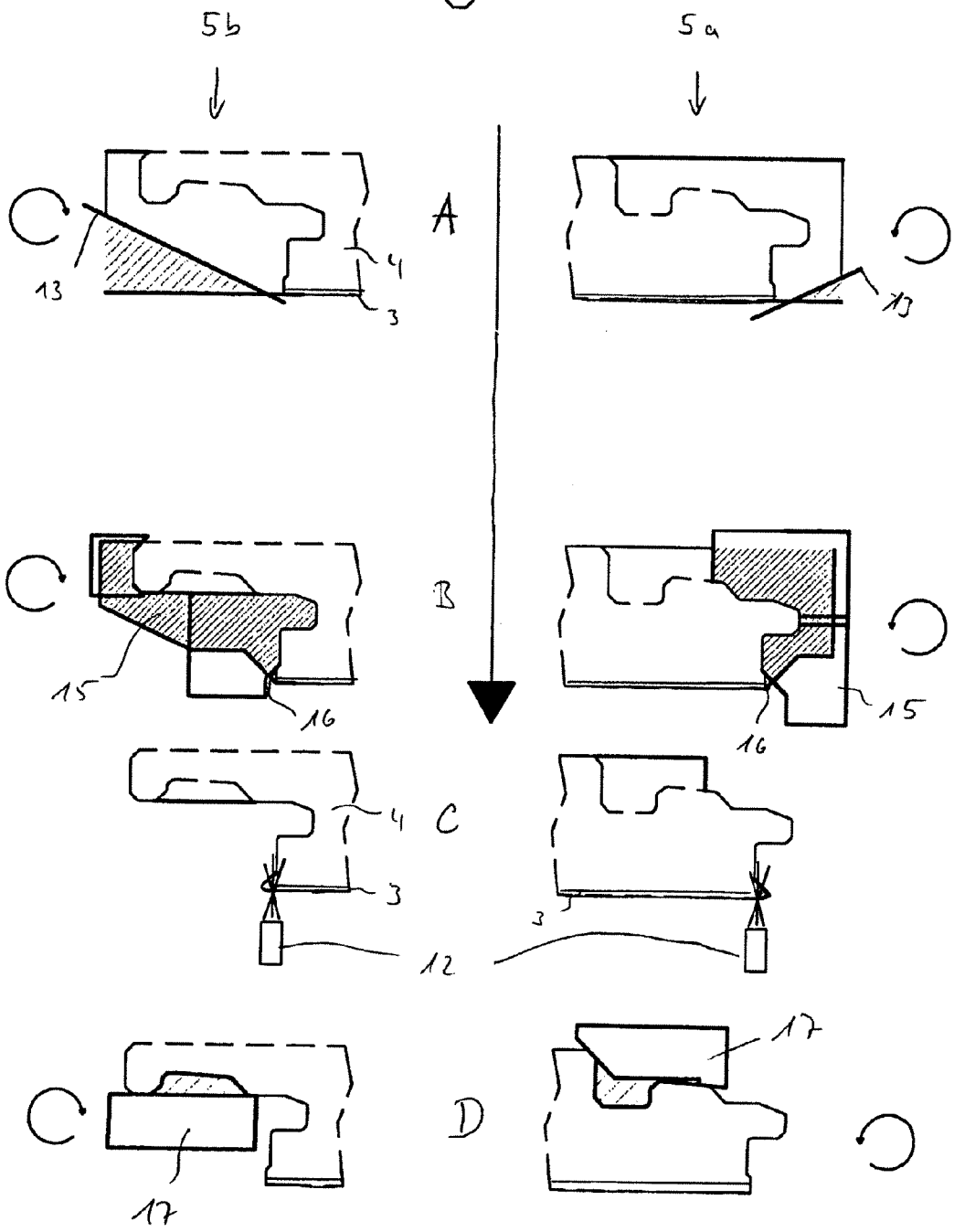

An embodiment of the invention is explained in more detail in the following based on the drawings. The following are shown:

FIG. 1 a perspective, schematic illustration of a part of a covering made of panels, FIG. 2 an enlarged partial illustration of a first joining element of a joining profile, FIG. 3 an enlarged partial illustration of the corresponding joining element of the joining profile, FIG. 4 a schematic illustration for implementing the method according to the invention, FIG. 5 a schematic illustration of various steps to be used in implementing the method according to the invention, and FIGS. 6-12 schematic illustrations of the disadvantages of the state of the art and the advantages of the invention.

FIG. 1 shows in a perspective, schematic illustration a part of a covering 1, which is composed of a large number of individual, preferably identical, board or strip-shaped panels 2, wherein only two panels 2*a* and 2*b* are illustrated. In the illustrated embodiment the panels 2*a*, 2*b* are identical, so that only one of the panels is described for both of them.

In the illustrated embodiment each panel 1 consists of a so-called laminate, i.e. it contains a number of layers. In the illustrated embodiment the panel contains a surface layer 3 and a core 4. The surface layer 3 forms the upper side 3*a* of the panel, i.e. the used and visible surface. With floor panels the surface layer 3 is formed as a tread layer and usually contains a hard wear-resistant layer, for example of melamine resin, and a decorative layer, usually a wood decoration. The tread layer can however also consist of just one layer which fulfils both functions.

The core 4 is formed by a board of fibre material, such as for example a mineral, glass or preferably a wood-fibre material, in particular a chipboard or, preferably, an MDF board (medium density board) or an HDF board (highly compacted board). The two latter boards are wood-fibre boards and comprise pressed sawdust, bound together with a binder, usually melamine resin or other adhesives. Compared to pure chipboards of crushed and pressed wood chippings bound together with a binder, wood-fibre boards have the advantage that they exhibit a fine, almost homogeneous structure and can be profiled without any problem at their edges without tearing.

In the illustrated embodiment the surface layer 3 is attached directly to the core 4 and other layers are not present. With a floor panel 2 however the usual additional layers can be provided, for example an impact sound insulating layer, a heating layer, a compensating floor layer or similar.

For a preferable, adhesive-free layering of the panels 2, each panel 2 is provided with a joining profile 5 at a minimum of two opposite side areas running transversely to the surface 3*a*, in the illustrated embodiment the long side areas of the panels 2, the said profile comprising two corresponding and mutually engaging joining elements 5*a* and 5*b*. Each panel 2 can however also be provided with a joining profile of corresponding joining elements on oppositely situated short sides. The invention can furthermore be used on panels without a joining profile.

In FIGS. 2 and 3 a preferred shape of the joining profile 5 with two corresponding joining elements 5*a*, 5*b* is illustrated, wherein the joining element 5*a* is provided in each case on a long side of the panel 2 and the joining element 5*b* is provided on the opposite long side of the panel 2. The joining elements 5*a*, 5*b* comprise the usual mutually engaging projections and indentations, which are pushed into and/or rotated into and/or clipped into one another in the known manner and which ensure mutual locking of the panels 2 in all directions in the finished covering 1 without the use of adhesive. A large number of joining profiles of this nature are known so that they do not need to be explained in more detail in the following.

On each of the panels 2 preferably a joining edge 6 is formed circumferentially, with which the adjacent panels 2*a*, 2*b* butt together to form a joining line 7 (FIG. 1) appearing on the surface 3*a*.

In the illustrated embodiment the joining edge 6 is provided on a side protrusion 8, which extends over the surface layer 3 and over a part of the panel thickness into the core 4 and through to the upper side 3*a*. The protrusion 8 is limited outwards by a limiting surface 6*a* in which the joining edge 6 lies and which makes a right angle with the upper side 3*a*.

On laying the panels 2*a*, 2*b* for the floor covering 1 the limiting surfaces 6*a* of adjacent panels butt up against one another. In order to produce a joining line 7 as uniform and as invisible as possible, the joining edge 6 and, where necessary, the limiting surface 6*a* must be processed very exactly.

This is achieved by the method according to the invention.

On manufacturing the panels 2 first the usual boards 10 are made up from the laminate materials as shown in FIG. 4. In particular the board 10 includes the surface layer 3 and the core 4. This board 10 is, as shown in FIG. 4, conveyed in the usual manner by roller pairs 11, which exert a certain pressure on the board 10, rotate and thus convey the board 10 gently and continuously and at a high speed. Other suitable conveying devices can however also be used.

The board 10 is separated into single panel blanks 10*a* through parting lines 9 during the conveyance. Deviating from the state of the art, this occurs however with the aid of a laser device 12, which is only schematically illustrated, with a large number of adjacently located lasers of the conventional type spaced on the width of the panel blank 10*a*. Preferably a laser with 5 kW total power is used and is operating with a cutting power of 200 mW. The cutting power of the laser can however, as will be explained in the following, be appropriately modified for the desired results or can be adjustable. The width of the cutting line 9 produced by the laser is only a few tenths of a millimeter, preferably between 0.2 and 0.3 mm (compared to about 2.5 mm with conventional saws).

The board 10 is passed through the rollers 11 and under the laser 12 in an alignment in which the surface layer 3 is positioned upwards, i.e. turned to the laser 12.

The lasers cut up the board 10 completely into the single panel blanks 10*a* in one pass through the rollers 11 with the slightest amount of cut material between the blanks, so that excellent use is made of the material. Dust is not produced so that also the precautions for the extraction of dust, which are necessary with the mechanical tool, can be waived. The cutting speed is high. Despite this, neither friction occurs, which could modify the surface layer 3, nor breaking up, nor an uneven mechanical restriction through which vibrations can become established which are responsible for the oblique or wave-shaped cuts in the state of the art. The blanks 10*a* are thus manufactured with the optimum quality.

The use of lasers is furthermore particularly practicable in the production of the joining edge 6 in the region of the joining profile 5, as is more closely explained based on FIG. 5. FIG. 5 shows on the left side the manufacture of the joining element 5*b* of the joining profile 5 and on the right side the manufacture of the joining element 5*a* of the joining profile 5. The arrows drawn in circles indicate that for this manufacturing step mechanically rotating tools are used in each case. For example, in step A in each case a mechanical milling cutter or saw 13 is used, whereas in the following step B milling cutters, for example face or profile milling cutters 15, are used.

According to the invention, a piece of residual material 16 is left on both joining elements 5*a*, 5*b* in the course of the process steps A and B at a place containing the later joining edge 6. The piece of residual material 16 can exhibit any suitable shape resulting from the method.

This residual piece 16 is cut off in the process step C with the aid of a laser 12, wherein the laser beam for forming the joining edge 6 extends through the surface layer 3. Preferably the laser beam also extends into the adjacent region of the core 4 to form the limiting surface 6*a*. Where applicable, reflector plates or other suitable measures can be employed to ensure that regions of the joining elements 5*a*, 5*b* already finished are not impaired or damaged.

Furthermore, the residual piece 16 is cut off such that the protrusion 8 illustrated in FIGS. 2 and 3 remains.

Through the use of the laser 12 here an exact, accurately running, straight joining edge 6 is produced which gives an almost invisible parting line 7 in the finished covering 1. Furthermore, the regions of the core adjacent to the surface layer 3 are influenced by the laser such that the water absorption capability is substantially reduced. In particular this occurs by melting the binder in the fibre material, in particular of the melamine in the HDF or MDF boards and, where applicable, through a slight coking due to the heat of the laser. Thus, the ingress of water is prevented in two ways. For one thing, the parting line 7 is so thin that water can hardly penetrate due to its surface tension, but if water should penetrate then the regions cut by the laser cannot absorb it so that swelling of the core 4 with lifting of the surface layer 3 cannot occur.

Then the joining elements are finished off in step D in the usual manner by rotating, mechanical tools 17.

A further possible use in the employment of lasers in the manufacture of panels is in the surface treatment. Thus, the surface 3*a* can be provided, for example, with the indentation cuts 18 indicated in FIG. 1 for decorative or technically functional purposes. The indentation cuts 18 can be implemented so wide that they are easily visible. Here too, break up of the edges or deviations from the ideal position are prevented and an improved water resistance is obtained.

In a deviation of the described and drawn embodiment, cuts other than the parting line, joining edge, indentation cuts and the limiting surface can also be produced by lasers depending on where and with which cutting operation the advantages described above are to be obtained. The invention can also be used with panels with different joining profiles. Other wood-fibre materials can be used for the core material. Although the invention is particularly suitable to the manufacture of floor panels with a core of wood-fibre materials and a surface layer formed as a tread layer, according to the invention also other panels, e.g. for cladding a wall or similar feature or for furniture, can be manufactured. The panels can comprise more than the described layers or consist of just one material, e.g. a wood material, with or without surface treatment.

The invention claimed is:

1. A method of manufacturing a panel (2), wherein the panel (2) comprises a core (4) of a fibre materials, preferably an MDF or HDF board, characterised in that at least one cut (6, 6*a*, 9) on the panel (2) is cut with a laser wherein the panel (2) includes a joining profile (5) provided at two opposite side areas of the panel (2), the panel (2) containing a surface layer (3), the laser cut for forming a joining edge (6) runs through the surface layer (3).

2. The method according to claim 1, characterised in that the laser cut (6*a*, 9) runs at least partly through the core (4) of the fibre material.

3. The method according to claims 1 or 2, characterised in that the laser cut (6*a*) runs through the surface layer (3) and at least partly into the core (4).

4. The method according to claim 3, characterised in that on one side of the panel (2) a protrusion (8) is formed, containing a joining edge (6) cut by laser.

5. The method according to claim 4, characterised in that during the manufacture of a joining profile on one side of the panel (2), a residual piece (16) from the core material (4) remains on the core (4) and is subsequently cut off with a laser.

6. The method according to claim 5, characterised in that the residual piece (16) remains at the transition of a surface layer (3) to the core(4).

7. The method according to claim 6, characterised in that a board (10) is manufactured from the core (4) and a surface layer (3) joined to the core (4) and a panel blank (10*a*) is cut from the board (10) by the laser (12).

8. The method according to claim 7, characterised in that a large number of lasers (12) spaced adjacent to one another and spaced at the width of the panel blanks (10*a*) are provided for cutting up the board (10) into a large number of panel blanks (10*a*).

9. The method according to claim 8, characterised in that the power of the laser is matched to the core materials (4) such that the laser cut offers an improved resistance to the ingress of water for the core material.

10. The method according to claim 9, characterised in that a surface (3*a*) of the panel (2) is processed by laser.

11. A floor panel (2), with a tread layer (3) and a core (4) of a wood-fibre material, preferably and MDF or HDF board, characterised by a joining edge (6) produced by a laser cut, wherein the laser cut runs through the tread layer (3) and at least partly into the core (4), and wherein the floor panel (2) includes a joining profile (5) provided at two opposite side areas of the panel (2).

* * * * *